United States Patent [19]

Celez

[11] Patent Number: 4,618,329

[45] Date of Patent: Oct. 21, 1986

[54] WATER SLIDERS

[76] Inventor: Remy Celez, 9112 W. Fort St., Detroit, Mich. 48209

[21] Appl. No.: 636,167

[22] Filed: Jul. 31, 1984

Related U.S. Application Data

[63] Continuation-in-part of Ser. No. 515,868, Jul. 21, 1983, abandoned.

[51] Int. Cl.[4] ..... A63C 15/00

[52] U.S. Cl. ..... 441/76; 441/65

[58] Field of Search ..... 441/76, 65, 68, 71, 441/74, 75, 77, 79

[56] References Cited

U.S. PATENT DOCUMENTS

| | | | |
|---|---|---|---|
| 1,476,705 | 12/1923 | Mardus | 441/76 |
| 3,108,296 | 10/1963 | Smith | 441/76 |
| 3,144,849 | 8/1964 | Maser | 441/76 |
| 3,541,623 | 11/1970 | Duda | 441/76 |
| 3,936,896 | 2/1976 | Creamer | 441/76 |
| 4,129,912 | 12/1978 | Robinson | 441/76 |

*Primary Examiner*—Trygve M. Blix
*Assistant Examiner*—C. T. Bartz

[57] ABSTRACT

A pair of water sliders each comprising of a foot strap fastened on top of the float assembly and a tail having its forward part inserted and bonded to the rear of the float assembly. The water sliders are made of light materials for greater buoyancy but strong and durable to enable the wearer to float, slide or walk on the surface of the water.

2 Claims, 7 Drawing Figures

WATER SLIDERS

CROSS-REFERENCE TO RELATED APPLICATIONS

This is a continuation-in-part of prior application Ser. No. 515,868; filed July 21, 1983 and now abandoned.

BACKGROUND OF THE INVENTION

1. Field of the Invention

This invention relates to a pair of water sliders.

2. Description of the Prior Art

Equipments or devices used for traveling on the surface of the water are propelled by some elements, such as: the wind pushing a sailboat or a sailboard, the wave pushing a surfboard, an outboard motor propelling a boat, the water skis with a skier being pulled by a motorized boat and the paddle propelling a boat.

No equipment or device presently used has the capability to be propelled on the surface of the water without the help or use of the elements mentioned above.

SUMMARY OF THE INVENTION

The invention disclosed herein is a pair of water sliders each comprising of a float assembly, a foot strap and a tail.

During the forward sliding motion of one of the water sliders the other water slider at the rear slides back trapping water inside the open rear of the tail. The water react by stopping the water slider at the same time pushing the tail forward. The forward sliding motion of the water sliders and the reaction force of the water propel the water slider forward without pushing or pulling the wearer or the water sliders.

The water sliders are made of light materials for great buoyancy but strong and durable to support and enable a person to float, walk and slide on the surface of the water.

Accordingly, it is an object of this invention to provide a pair of water sliders used for floating, walking and sliding on the surface of the water.

Another object of this invention is to provide a pair of water sliders that is safe to use and inexpensive to manufacture.

Further object of this invention will become apparent from the following detailed description together with the accompanying drawings.

DESCRIPTION OF THE PREFERRED EMBODIMENTS

Figure 1:
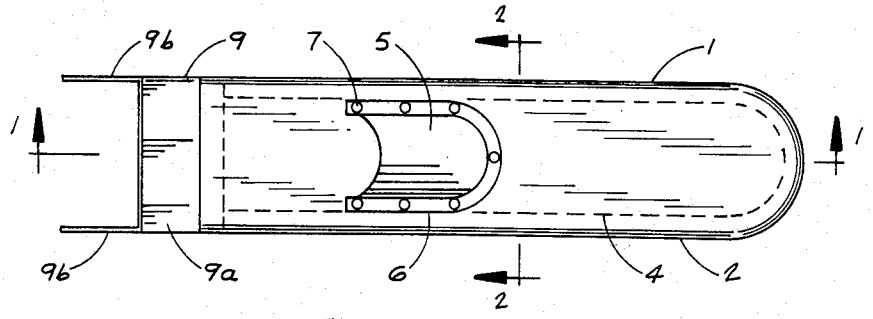
FIG. 1 is a top plan view of the water slider.

The following description is made with reference to the drawings, wherein like reference characters designates like or corresponding parts throughout the different views. The numeral 1 generally designates one of the water sliders constructed in accordance with the invention from:

The shell 2 FIGS. 1, 2, 3, 5 and 7 is made of an elongated, tough, wear resistant plastic having a hollow inside portion with a rectangular cross-section. The bottom side of the forward part slightly tapers upwardly with a circular end. The shell 2 has an opening at the rear end only. The shell 2 is formed by molding and provided with a row of holes at the top side forming a U-shape for fasteners such as bolts or screws 7 to pass through.

Figure 2:
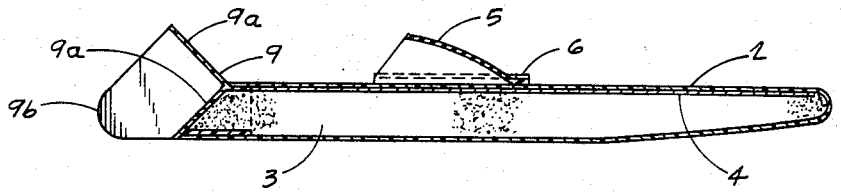
FIG. 2 is a longitudinal sectional view taken along line 1—1 of FIG. 1.
Figure 3:
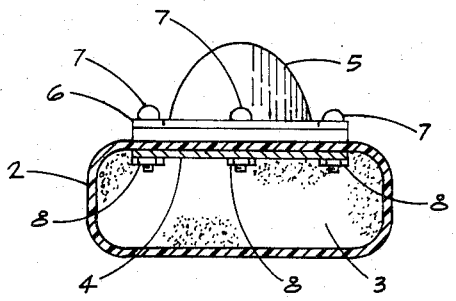
FIG. 3 is an enlarged sectional view taken along line 2—2 of FIG. 1.
Figure 4:
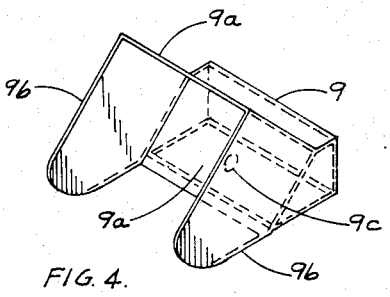
FIG. 4 is a perspective view of the tail.
Figure 6:
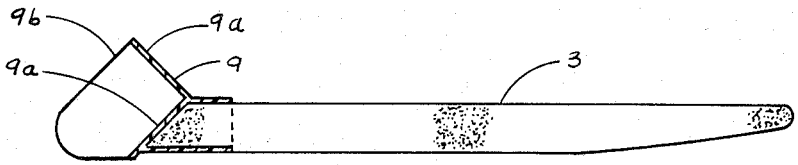
FIG. 6 is a longitudinal sectional view taken along line 1—1 of FIG. 1 showing the rear end of the float inside the hollow forward part of the tail.
Figure 7:
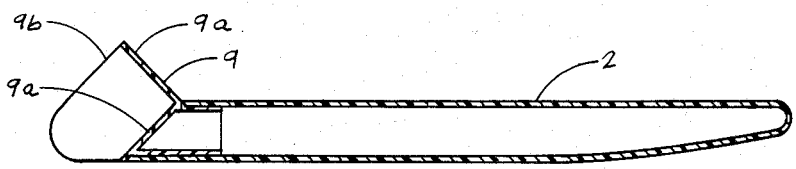
FIG. 7 is a longitudinal sectional view taken along line 1—1 of FIG. 1 showing the forward part of the tail bonded inside the open rear end of the shell.

The float 3 FIGS. 2, 3 and 6 is made of a synthetic foam known for its buoyancy and does not absorb water, formed by molding a slab of foam to fit inside the shell 2. The float 3 can also be made by injecting a liquid foam inside the shell 2.

Figure 5:
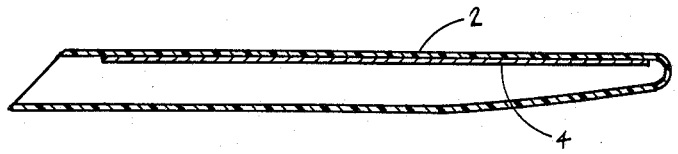
FIG. 5 is a longitudinal sectional view taken along line 1—1 of FIG. 1 showing the stiffener bonded inside the top of the shell.

The stiffener 4 FIGS. 2, 3 and 5 is a hard and strong strip of plastic, wood or light metal especially aluminum provided with a plurality of holes that correspond to the holes at the top side of the shell 2.

The foot strap 5 FIGS. 1, 2 and 3 is made of plastic or rubber that is open at its enlarged rear end and tapers downwardly at its forward end. The foot strap 5 is provided with holes around its front and side edges that correspond to the holes of the shell 2 and the stiffener 4.

The clamp 6 FIGS. 1, 2 and 3 is a U-shape bar made of plastic or light metal provided with holes along the center of its length that correspond to the holes of the shell 2, stiffener 4 and the foot strap 5.

The plurality of bolts or screws 7 and nuts 8 FIGS. 1 and 3 are made of light metal especially aluminum.

The tail 9 FIGS. 1, 2, 4, 6 and 7 is made by molding a tough and water resistant plastic and also by fabricating a sheet of light metal especially aluminum. The tail 9 consisting of a hollow forward part and an open rear part. The hollow forward part fitting snugly inside of the rear of the shell 2.

The open rear part consisting of a first set of two flat panels **9*a*, placed at an angle to each other, one panel 9*a* covering the opening at the rear part of the float 3, the other panel 9*a* rising above the top of the shell 2, the intersection of the two panels forming a line which also intersects the upper edge of the opening at the rear of the shell 2**.

The open rear part also consisting of a second set of two flat panels **9*b*, each panel 9*b* being perpendicular to and on opposite sides of the set of first flat panels 9*a*, two edges of each of said second set of two flat panels 9*b* being connected to one edge each of first set of two flat panels 9*a*, one edge each of each of the second set of two flat panels 9*b*, being connected respectively to each of the sides of the rear opening of the shell 2. The open rear part forming an opening away from the rear part of the water sliders 1**, and facing backwardly.

The bonding element (not shown) is an epoxy resin has a quality for greater adhesion and superior strength.

The float assembly as shown in FIGS. 2 and 3 comprised of the shell 2, float 3 and the stiffener 4.

To assemble, the bonding element is applied on the surface of the stiffener 4 by a brush then bonded on top of the float 3. The float 3, with the stiffener 4, is then inserted inside the open rear end of the shell 2, the stiffener 4 being located between the upper part of the shell 2 and the upper part of the float 3.

The inside and outside surfaces of the forward part of the tail 9 are applied with the bonding element, then inserted and bonded inside the open rear end of the shell 2 with the rear end of the float 3 is inside the hollow forward part of the tail 9.

The foot strap 5 is clamped and fastened on the top side of the float assembly by the plurality of fasteners such as bolts or screws 7 passing through the holes of the clamp 6, foot strap 5, shell 2, stiffener 4 and the nuts 8.

The water slider 1 can also be manufactured and assembled wherein a hole 9*c* is provided in the one of the first set of the rear flat panels 9*a* covering the rear part of the float 3. The tail 9 and the foot strap 5 are then attached and mounted to their designated places in similar manner described above. The liquid synthetic foam is then injected inside the shell 2 through the hole 9*c* to bond with the shell 2 and with the forward part of the tail 9. The liquid synthetic foam is then left to harden.

OPERATIONS

The shell 2 FIGS. 1, 2, 3, 5 and 7 means for enclosing the float 3, stiffener 4 and the forward part of the tail 9.

The float 3 FIGS. 2, 3 and 6 means for floating the whole embodiment of the invention to enable a person to float on the surface of the water.

The stiffener 4 FIGS. 1, 2, 3 and 5 means for strengthening the float assembly and supporting the foot strap 5.

The foot strap 5 FIGS. 1, 2 and 3 means for wearing and holding the wearer's foot for good balance and easy to slip in or out the wearer's foot.

The clamp 6 FIGS. 1, 2 and 3 is for holding the foot strap 5 to the float assembly.

The plurality of fasteners FIGS. 1 and 3, such as bolts or screws 7 and nuts 8, are for fastening the foot strap 5 to the float assembly.

The tail 9 FIGS. 1, 2, 4, 6 and 7 means being used for propelling and steering by trapping water and forming a resistance to the rearward movement of the water slider 1 to enable a person to slide and walk on the surface of the water.

The bonding element (not shown) is for bonding the shell 2, the stiffener 4, the float 3 and the tail 9.

All materials comprising the construction of the invention described above are made of light materials for greater buoyancy but strong and durable to support and enable a person to float, walk and slide on the surface of the water.

Each of the water slider 1 can carry more than one half of the weight of the wearer, therefore, a pair of water sliders can carry more than the weight of the wearer. This carrying capacity gives the wearer good floating ability as well as good balance.

To use, each foot wears a water slider 1 and stands on the water with both legs straight to distribute the weight evenly to each of the water slider 1. As one of the water slider 1 is moved forward in a sliding motion, the other water slider 1 at the rear slides back trapping water inside the open rear part of the tail 9. The water reacts by stopping the water slider 1 at the same time pushing the tail 9 forward. The reaction force of the water and the forward sliding motion of the body propel the water slider 1 forward. As the feet keep on moving one after the other continuously, the water slider 1 slide forward enabling the wearer to slide or walk on the surface of the water.

Although the foregoing includes a description of the best mode contemplated for carrying out the invention, it will be understood that other embodiments, changes and modifications may be made without departing from the scope of the invention in the construction herein described and illustrated. It is intended that all matters contained in the foregoing description or shown in the accompanying drawings shall be interpreted as illustrative rather than limiting.

What is claimed is:

1. A pair of water sliders for floating, walking or sliding on the surface of water, each water slider comprising:

a shell means for enclosing a float means, a stiffener means, a tail means and a foot strap means;

said shell means having an opening at the rear only;

said float means enabling the wearer to float on the surface of the water and being made of a slab of foam;

said stiffener means for strengthening the water slider, and being located between the upper part of the shell means and the upper part of the float means;

said tail means being used for propelling and steering and consisting of a hollow forward part and an open rear part;

said hollow forward part fitting snugly inside of the rear of the shell means;

said open rear part consisting of a first set of two flat panels, placed at an angle to each other, one panel covering the opening at the rear part of the float means, the other panel rising above the top of the shell means, the intersection of the two panels forming a line which also intersects the upper edge of the opening at the rear of the shell means;

said open rear part also consisting of a second set of two flat panels, each panel being perpendicular to and on opposite sides of the set of first flat panels, two edges of each of said second set of two flat panels being connected to one edge each of first set of two flat panels, one edge each of each of the second set of two flat panels being connected respectively to each of the sides of the rear opening of the shell means;

said open rear part forming an opening away from the rear part of said water sliders, and facing backwardly, such as to trap water and form a resistance to rearward movement of the water slider;

said foot strap means holding the wearer's foot.

2. A pair of water sliders according to claim 1 wherein a hole is provided in the one of the first set of rear flat panels, covering the rear part of the float means, said float means being made of liquid synthetic foam injected inside said shell means through said hole to bond with said shell means and with the forward part of said tail means.

* * * * *